US005758578A

United States Patent [19]

Metrope

[11] Patent Number: 5,758,578

[45] Date of Patent: Jun. 2, 1998

[54] DEVICE FOR EXCHANGING PRINTING FORMS IN PRINTING UNITS OF PRINTING PRESSES

[75] Inventor: Jacques Metrope, Laigneville, France

[73] Assignees: Heidelberger Druckmaschinen AG, Heidelberg, Germany; Heidelberg Harris S.A., Montataire Cedex, France

[21] Appl. No.: 666,012

[22] Filed: Jun. 19, 1996

[30] Foreign Application Priority Data

Jun. 19, 1995 [FR] France ..... 95 07287

[51] Int. Cl.[6] ..... B41F 21/00

[52] U.S. Cl. ..... 101/477

[58] Field of Search ..... 101/477, 415.1, 101/378, 132

[56] References Cited

U.S. PATENT DOCUMENTS

| | | | |
|---|---|---|---|
| 5,181,466 | 1/1993 | Ono | 101/477 |
| 5,323,699 | 6/1994 | Motoe et al. | 101/477 |
| 5,483,892 | 1/1996 | Stiel | 101/477 |
| 5,555,810 | 9/1996 | Stiel | 101/477 |
| 5,555,811 | 9/1996 | Ruckmann et al. | 101/477 |

FOREIGN PATENT DOCUMENTS

| | | |
|---|---|---|
| 62-19458 | 1/1987 | Japan . |

*Primary Examiner*—Eugene H. Eickholt

*Attorney, Agent, or Firm*—Herbert L. Lerner; Laurence A. Greenberg

[57] ABSTRACT

Device for exchanging printing forms on a form cylinder in a printing unit of a rotary printing press, a holding device being provided in the printing unit for both holding therein at least one printing form which is to be installed, as well as at least one printing form which is being removed, includes profile members for guiding the printing forms substantially by lateral regions thereof.

7 Claims, 2 Drawing Sheets

DEVICE FOR EXCHANGING PRINTING FORMS IN PRINTING UNITS OF PRINTING PRESSES

BACKGROUND OF THE INVENTION

FIELD OF THE INVENTION

The invention relates to a device for exchanging printing forms on a form cylinder in a printing unit of a rotary printing press, a holding device being provided in the printing unit for both holding therein at least one printing form which is to be installed, as well as at least one printing form which is being exchanged.

Printing-form exchanging devices have become known heretofore in the state of the art, for example, from the published European Patent Document EP 0 503 750 A1. According to the foregoing document, printing-form holders which are provided on a guard of the printing unit, hold a rear or trailing edge of a printing form to be mounted during the installation thereof on the plate cylinder.

The published European Patent Document EP 0 530 565 A1 discloses a magazine intended for exchanging printing plates automatically. Several plates can be held ready in the magazine for effecting the exchange, a cassette containing several plates being introducible into the magazine. As required, these printing plates are removable by the plate-feeding device.

The published European Patent Document EP 0 567 754 A1 discloses a device for feeding a printing plate to a plate cylinder of a printing press. In this device, the printing surface of a printing form is protected by supporting and guiding the printing form by at least one easily rotatable roller. The side of the roller facing towards the printing unit lies in a plate-exchanging position substantially on a straight line extending parallel to the gripping surfaces of the device for receiving therein the front or leading edge of a printing plate, and passes between these gripping surfaces and extends out of the printing unit obliquely upwardly. The guiding element, which is constituted by the roller, may also be formed by a sucker.

The published European Document EP 0 57 0 7 02 A1 discloses a device for feeding printing plates to the plate cylinder of printing presses, in particular sheet-fed printing presses. A guard movable on a guide rail on the printing unit is formed with a slightly curved sheetmetal profile member. The sheetmetal profile member has an insertion rail or bar for introducing the front or leading edge of the printing plate, which is to be installed, directly into the gripping zone of the clamping or lock-up devices of the plate cylinder.

All of the aforementioned constructions have many moving parts which, in part, even when they are not being used, at least limit access to the printing unit. Moreover, some of the aforementioned heretofore-known constructions do not always ensure that the printing surface of the respective printing forms is well protected.

SUMMARY OF THE INVENTION

It is accordingly an object of the invention to provide a device for exchanging printing forms in a printing unit of a printing press which is improved over corresponding devices of the prior art, wherein the number of parts present over the width of the printing unit remain within the pressman's zone of access during the operation of the printing unit, so that the printing unit remains accessible virtually without hindrance.

With the foregoing and other objects in view, there is provided, in accordance with the invention, a device for exchanging printing forms on a form cylinder in a printing unit of a rotary printing press, a holding device being provided in the printing unit for both holding therein at least one printing form which is to be installed, as well as at least one printing form which is being removed, comprising profile members for guiding the printing forms substantially by lateral regions thereof.

In accordance with another feature of the invention, each of the profile members is formed with grooves enveloping the lateral regions of the printing forms.

In accordance with a further feature of the invention, the grooves follow an S-shaped profile along the profile members.

In accordance with an alternative feature of the invention, the grooves follow a meander-shaped curve in the profile members.

In accordance with another alternative feature of the invention, the grooves follow a rectilinear profile in the profile members.

In accordance with an added feature of the invention, at least one drive unit, respectively, is provided in each of the profile members for transporting both the printing form which is to be installed and the printing form which is being removed.

In accordance with an additional feature of the invention, the drive units, respectively, are cooperatively associated with supporting elements for transporting the printing forms by friction applied to lateral regions thereof.

In accordance with yet another feature of the invention, the supporting elements are formed as rollers.

In accordance with an alternative feature of the invention, the supporting elements are formed as belts.

In accordance with yet a further feature of the invention, the lateral regions of the printing forms are gripped at both sides thereof.

In accordance with yet an added feature of the invention, the profile members are fixedly mounted on side frames of the printing unit.

In accordance with a concomitant feature of the invention, the profile members are swivellably mounted on side frames of the printing unit.

The advantages attainable by the construction according to the invention are, in particular, that no element comes into contact with the printing surfaces of the printing forms or plates. The guidance of the printing forms or plates in the laterally arranged profile members ensures that, after the printing forms or plates have been installed on the surface of the plate cylinder, not a single part remains within the working zone of the respective printing unit. The pressman thus has unhindered access to the printing unit for cleaning and for any required or desirable maintenance work.

According to another advantageous construction of the device according to the invention, the profile members may be mounted either in a fixed position or swivellably on the support side frames of the printing unit. Advantageously, the profile members are formed with grooves which surround or envelop the lateral regions of the printing forms or plates and thus serve as guides. The grooves may follow meander-shaped or sinuous, advantageously S-shaped, curves in the profile members so as to give the printing forms or plates which they support a deformation which stiffens them and makes them insensitive to vibrations in the printing unit, and enables them to be laterally guided in these grooves.

The profile members are, moreover, equipped with drive units, namely for driving a first printing form or plate which is to be installed and a second plate which is to be removed. The drive units, for example, small-size electric motors which are equipped with friction rollers, cooperate with supporting elements so that the printing forms or plates can be transported by the application of frictional force at both sides of the lateral regions thereof. The aforementioned supporting elements may be formed either of rollers or of belts. The lateral regions may be guided in the respective grooves of the profile members in the vicinity of the drive units.

Other features which are considered as characteristic for the invention are set forth in the appended claims.

Although the invention is illustrated and described herein as embodied in a device for exchanging plates in printing units of printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
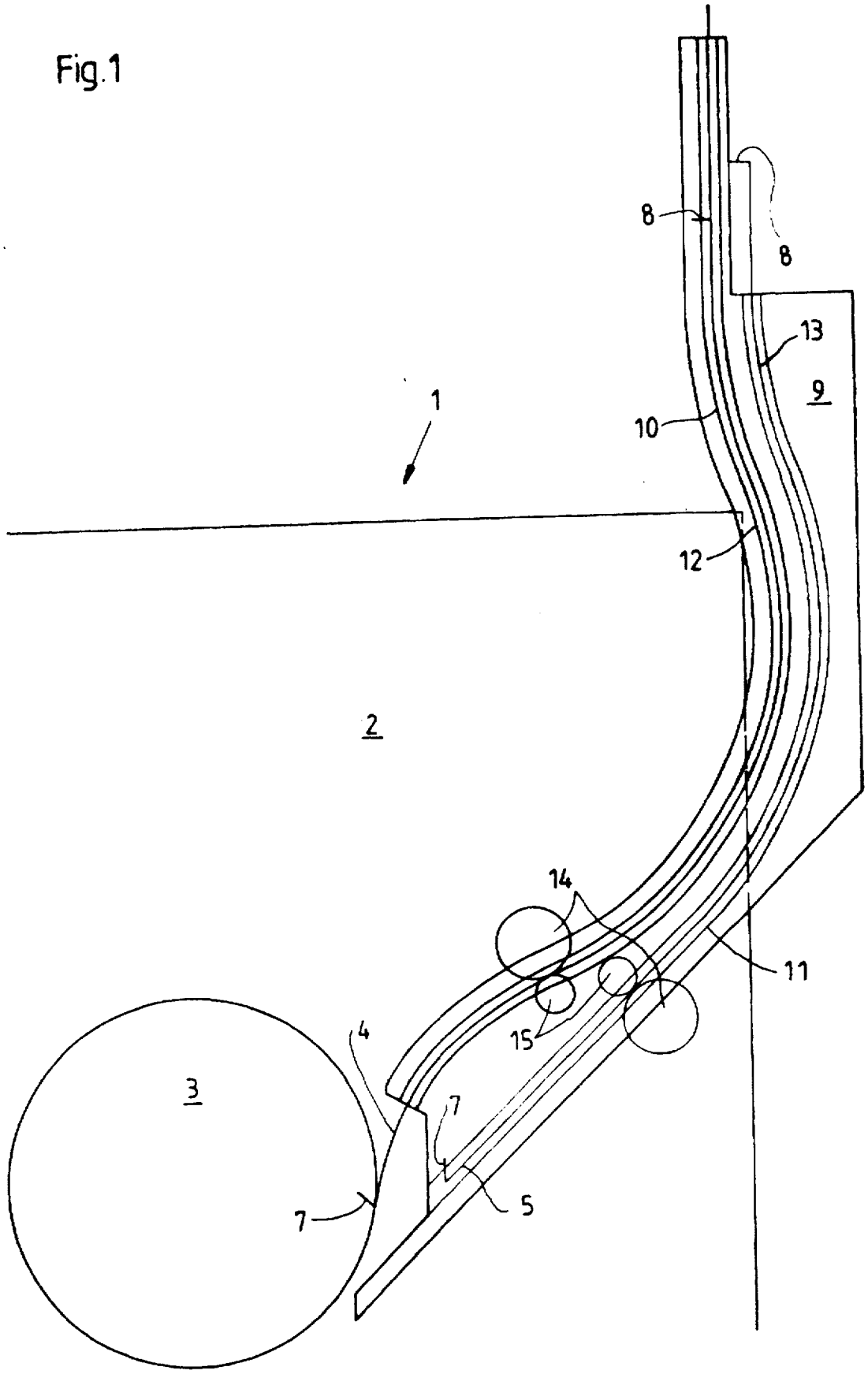
FIG. 1 is a diagrammatic side elevational view of profile members having two printing forms guided therein in a printing unit of a rotary printing press.

Referring now to the drawings and, first, particularly to FIG. 1 thereof, there is shown therein an embodiment of the device according to the invention provided at an upper printing-form or plate cylinder 3 of a printing unit 1. For a printing unit printing on both sides of a continuous web of paper, the device of the invention may also be provided without any difficulty at the lower plate cylinder.

A respective profile member 9 is affixed to each of the two support frames 2 of the printing unit 1. Each of these profile members 9 carries at least one first printing form 4, which is to be newly installed on a corresponding printing-form cylinder 3 of the printing unit 1, as well as at least one second printing form 5, which has been removed previously from the printing-form cylinder 3. Each of the printing forms 4 and 5 has a front or leading edge 7 and a rear or trailing edge 8 which are introduced into the gripping devices which are located on the circumference of the plate cylinder 3 and which fix them to this circumference. Lateral regions 6 (note FIG. 2) of the printing forms or plates 4 and 5 are guided in respective profiles 10 and 11 located on or in the profile members 9. The profiles 10 and 11 for receiving or accommodating the lateral regions 6 of the printing forms or plates 4 and 5 are formed of surfaces defining grooves 12 and 13 which follow meander-shaped or sinuous curves on or in the profile members 9. Advantageously, the grooves 12 and 13 thus follow an S-shaped curve. By means of the curvature imposed by the grooves 12 and 13 upon the printing forms or plates 4 and 5, the latter are stiffened so that guidance thereof provided only along the lateral edges 6 is fully sufficient. Thus, no accessory or auxiliary guidance is required for acting upon the printing surface of the printing forms or plates 4 and 5, thereby considerably reducing the risk of damage to the sensitive surfaces.

For small-size printing forms or plates having sufficient rigidity provided by the front and rear, i.e., leading and trailing, edges thereof, it is advantageous for the grooves in the profile members to follow a rectilinear profile along the latter.

Drive units 14 are provided in the profiles 10 and 11 of the profile members 9. These drive units 14 cooperate with supporting elements 15 which, in the illustrated embodiment, are formed as rollers. The supporting elements 15 may also be formed as belts or chains formed of plastic material.

Figure 2:
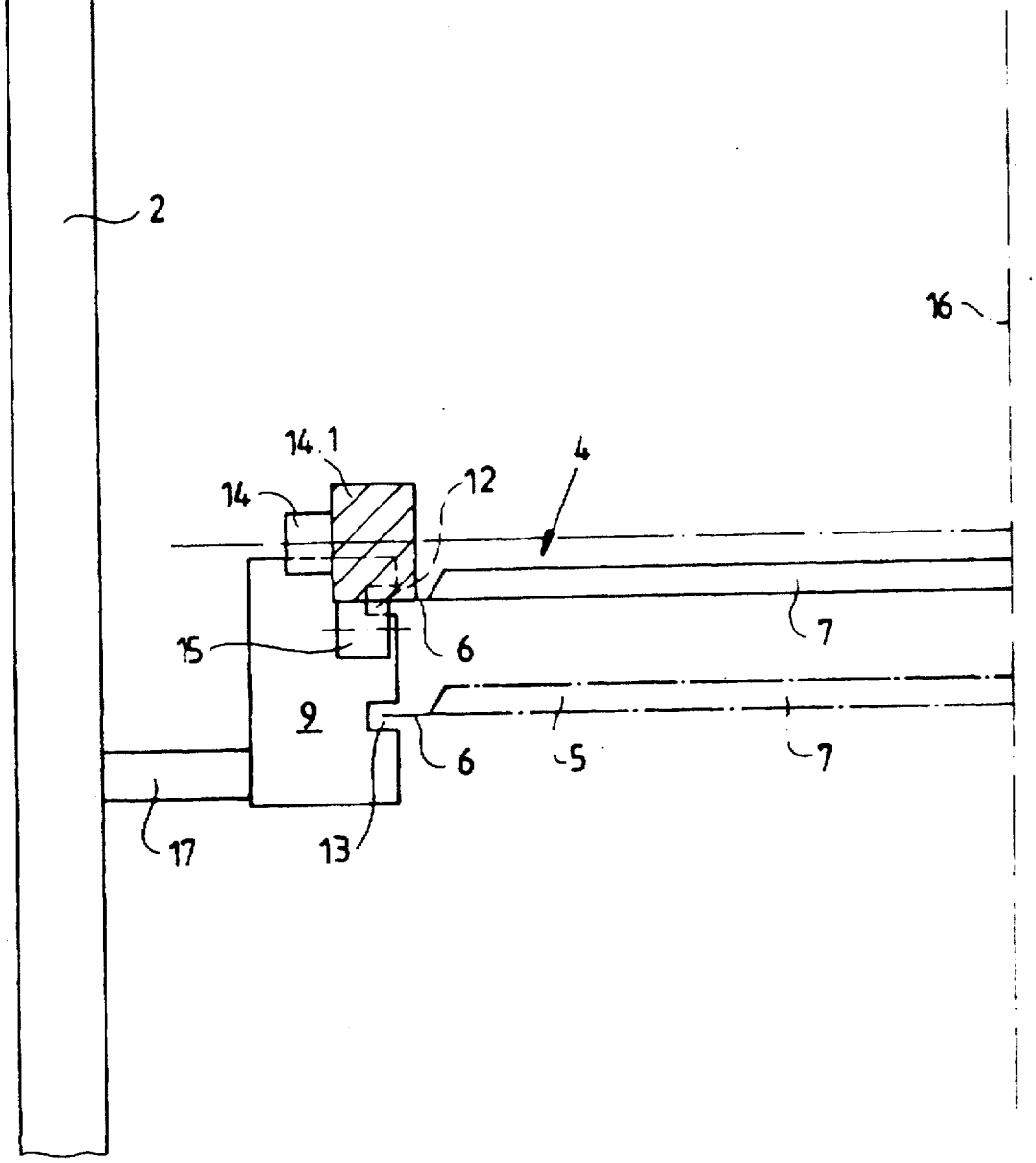
FIG. 2 is a fragmentary front elevational view, partly in section, of FIG. 1, showing a region of the profile members wherein drive units are arranged.

FIG. 2 shows in detail the arrangement of the drive units provided on the profile members.

The drive units 14, which include friction rollers 14.1, lie on the profile members 9 which may be connected by a fixture or fastener 17 to the respective support frames 2, yet could also be swivellable. Due to the symmetry of the construction, only half of the printing unit to the middle 16 of the printing press is shown in FIG. 2. The friction rollers 14.1 cooperate with the supporting elements 15 which are provided therebeneath them. The respective friction roller 14.1 cooperating with the supporting element 15 grips the lateral region 6 of the printing form or plate 4 on both sides thereof and transports it to the surface of the printing-form or plate cylinder 3, which is not shown in FIG. 2. A drive unit 14 like that shown in FIG. 2 is arranged on the non-illustrated opposite support frame 2 of the printing unit in order that the printing forms or plates 4 and 5, i.e., the respective printing form or plate being installed and being exchanged or removed, are transported satisfactorily.

At least one drive unit 14 is provided for each of the grooves 12 and 13 in the profile member 9. It is also possible, of course, to provide several drive units 14 along the path in which each of the plates 4 and 5 is transported. The grooves 12 and 13 may be provided, as required, directly in the profile members 9 or may be in separate U-shaped profiles which are fixed to the profile members 9. Drive units 14 like those shown along the transport path of the first plate 4 in FIG. 2 are also disposed along the transport path of the second plate 5 which is to be removed, although those drive units are not shown in FIG. 2.

By means of the illustrated friction rollers 14.1 cooperating with the support element 15, the regions 6 of the printing forms or plates 4 and 5 are guided somewhat centrically in the cross section of the grooves 12 and 13, so that an abrasion of the surfaces defining the grooves 12 and 13 can be effectively avoided.

As noted hereinbefore, it is also conceivable to guide small printing forms or plates 4 and 5 in respectively rectilinear grooves 12 and 13. Smaller printing forms or plates 4 and 5 have an increased stiffness or rigidity due to the smaller dimensions thereof; consequently, no deformation of the smaller printing forms or plates 4 and 5 which would tend to produce a stiffening thereof actually occurs during the installation or application thereof.

I claim:

1. Device for exchanging printing forms on a form cylinder in a printing unit of a rotary printing press, a holding device being provided in the printing unit for both holding therein at least one printing form which is to be installed, as well as at least one printing form which is being removed, comprising profile members for guiding the printing forms substantially by lateral regions thereof, each of said profile members having grooves formed therein for enveloping said lateral regions of the printing forms, and said grooves follow an S-shaped profile along said profile members.

2. Device according to claim 1, wherein at least one drive unit, respectively, is provided in each of said profile members for transporting both the printing form which is to be installed and the printing form which is being removed.

3. Device according to claim 2, wherein said drive units, respectively, are cooperatively associated with supporting elements for transporting the printing forms by friction applied to lateral regions thereof.

4. Device according to claim 3, wherein said supporting elements are formed as rollers.

5. Device according to claim 3, wherein said supporting elements are formed as belts.

6. Device according to claim 3, wherein said lateral regions of said printing forms are gripped at both sides thereof.

7. Device according to claim 1, wherein said profile members are fixedly mounted on side frames of the printing unit.

* * * * *